US011369237B2

(12) United States Patent
Li et al.

(10) Patent No.: US 11,369,237 B2
(45) Date of Patent: Jun. 28, 2022

(54) MATERIAL ROLL SUPPORT SYSTEM AND METHOD OF USING SAME

(71) Applicants: Alex Li, Richmond Hill (CA); Archie Tawatao, Willowdale (CA)

(72) Inventors: Alex Li, Richmond Hill (CA); Archie Tawatao, Willowdale (CA)

( * ) Notice: Subject to any disclaimer, the term of this patent is extended or adjusted under 35 U.S.C. 154(b) by 0 days.

(21) Appl. No.: 15/982,016

(22) Filed: May 17, 2018

(65) Prior Publication Data

US 2018/0333011 A1 Nov. 22, 2018

(30) Foreign Application Priority Data

May 19, 2017 (CA) ..... CA 2968082

(51) Int. Cl.
*A47K 10/22* (2006.01)
*A47K 10/40* (2006.01)
*A47K 10/38* (2006.01)

(52) U.S. Cl.
CPC ..... *A47K 10/22* (2013.01); *A47K 10/40* (2013.01); *A47K 10/38* (2013.01)

(58) Field of Classification Search
CPC ..... A47K 10/22; A47K 10/40; A47K 10/38
See application file for complete search history.

(56) References Cited

U.S. PATENT DOCUMENTS 2,146,038 A * 2/1939 West ..... A47K 10/40 242/564.4
2,583,411 A * 1/1952 Carlin ..... A47K 10/22 242/596.4
2,908,449 A * 10/1959 Bolger ..... A47K 10/32 242/596.1
2,948,486 A * 8/1960 Epeneter ..... A47K 10/38 242/596.4
2,978,197 A * 4/1961 Anderson ..... A47K 10/38 242/596.5
4,043,519 A * 8/1977 Suzuki ..... A47K 10/38 242/596.4
4,553,710 A * 11/1985 Pool ..... A47K 10/40 242/596.4
4,614,312 A * 9/1986 Del Pino ..... A47K 10/40 242/596.4
4,662,576 A * 5/1987 Paul ..... A47K 10/40 242/596.4

(Continued)

*Primary Examiner* — William A. Rivera

(74) *Attorney, Agent, or Firm* — Benesch Friedlander Coplan & Aronoff LLP

(57) ABSTRACT

The present invention is a material roll support system operable to hold of a roll of material and a method relating thereto. The material roll support system comprises two independent holder units, each of which can support one side of a roll of material. The independent holder units may be fixedly or non-fixedly attached to a surface, or may be held in a position solely by gravity. The surface upon which an independent holder unit is positioned may be supports, such as posts or other surfaces, such that a roll of material can be held by the independent holder units in an area or environment that contains such supports and between such supports. The independent holder units can further be positioned at varying distances from each other and the material roll support system can thereby can be used to support rolls of materials of varying widths.

13 Claims, 8 Drawing Sheets

(56) References Cited

U.S. PATENT DOCUMENTS

| | | | | | |
|---|---|---|---|---|---|
| 5,253,818 | A * | 10/1993 | Craddock | A47K 10/40 | 242/596.4 |
| 5,782,428 | A * | 7/1998 | Chabot | A47K 10/38 | 242/596.3 |
| 5,868,347 | A * | 2/1999 | Paul | A47K 10/40 | 242/596.4 |
| 6,189,828 | B1 * | 2/2001 | Reilly | A47K 10/40 | 242/596.4 |
| 6,286,781 | B1 * | 9/2001 | Lai | A47K 10/40 | 242/596.4 |
| 6,328,253 | B1 * | 12/2001 | Paul | A47K 10/40 | 242/596.3 |
| 6,386,478 | B2 * | 5/2002 | Reilly | A47K 10/40 | 242/596.4 |
| 6,666,364 | B2 * | 12/2003 | Phelps | A47K 10/40 | 225/106 |
| 6,837,455 | B2 * | 1/2005 | Eckhard | A47K 10/40 | 242/596.4 |
| 8,500,058 | B2 * | 8/2013 | Lan | B41J 15/042 | 242/578 |
| 8,616,491 | B2 * | 12/2013 | Smith | A47K 10/40 | 242/596.4 |
| 10,028,627 | B2 * | 7/2018 | Boeltl | A47K 10/40 | |
| 2003/0189126 | A1 * | 10/2003 | Hale | A47K 10/405 | 242/596.4 |
| 2015/0216375 | A1 * | 8/2015 | Okazaki | A47K 10/38 | 242/596.4 |

* cited by examiner

MATERIAL ROLL SUPPORT SYSTEM AND METHOD OF USING SAME

FIELD OF INVENTION

This invention relates in general to the field of a holder for a roll of material that is mountable upon a variety of supports, and more particularly to a system for dispensing material from a roll of material such as toilet paper, paper towel, plastic wrap, wrapping paper, fabric, or any other material wound around a roll.

BACKGROUND OF THE INVENTION

Holders for rolls of material are generally formed to incorporate insertion sections that insert into opposite sides of the roll, and such insertion sections are generally retractable by force, due to a reaction to force imposed upon a springy material or a spring element.

As an example of such prior art, U.S. Pat. No. 2,643,069 issued on Jun. 23, 1953 to A. F. Carlin, discloses an outwardly projecting lug that is moved to be positioned within a roll of toilet paper or a roll of paper towel due to its springy characteristic. The spring function of the projecting lug causes the lug to retract upon force being exerted on the lug, and causes the lug to extend once such force is removed.

Another example of such prior art is U.S. Pat. No. 1,651,867 issued on Dec. 6, 1927 to O. R. Boynton, that discloses an inclined plane positioned at the end of an arm. The inclined plane is shaped to fit within a roll of toilet paper, and the arm portion of such inclined plane is flexible. The inclined plane can be inserted into the roll when no force is exerted upon the arm portion, and retracted from the roll in response to force being exerted upon the arm portion.

Yet another example of such prior art is Chinese Patent Application No. 2013238071U applied for by Wuxi Nanligong Technology Development Co., Ltd., published as Chinese Patent Application Publication No. 203106959 on Aug. 7, 2013, that discloses pins that extend into a toilet paper roll when a spring is not under pressure. The pins retract from the roll when force or other pressure is applied to the spring.

Known prior art holders for a roll of material further are configured such that the insertion sections that are inserted within the roll of material are incorporated into a base portion, such that the insertion section are joined to the base portion and thereby joined to each other. Examples of such prior art include U.S. Pat. Nos. 2,643,069 and 1,651,867.

Alternatively, the known prior art discloses that the insertion sections extending within the roll are fixed to a particular surface. An Example of such prior art includes Chinese Patent Application Publication No. 203106959.

SUMMARY OF THE INVENTION

In one aspect, the present disclosure relates to a material roll support system comprising: two independent holder units, each independent holder unit incorporating: a holder base unit; a holder end that is attached to the holder base unit; and a connector that connects the holder end to the holder base unit such that the holder end is rotatable around an axis defined by the connector; whereby a roll of material is supportable between the two independent holder units upon the holder ends.

In another aspect the present disclosure relates to said material roll support system that further comprises two supports that the independent holder units are positioned upon when the material roll support system is assembled and operable.

In another aspect the present disclosure relates to said material roll support system that further comprises an indentation section in the holder base unit configured to receive a portion of the holder end.

In another aspect the present disclosure relates to said material roll support system wherein the indentation section is formed to restrain lowering of the holder end beyond a particular lowered position.

In another aspect the present disclosure relates to said material roll support system that further comprises a lowering inducing component positioned between the holder end and the holder base unit near to the connector, said lowering inducing component being operable to cause a raised holder end to start to move in a lowering direction.

In another aspect the present disclosure relates to said material roll support system wherein the lowering inducing component is formed of rubber, or the lowering inducing component is a magnet or a spring.

In another aspect the present disclosure relates to said material roll support system wherein the holder end and holder base unit are formed of plastic, polyvinyl chloride (PVC) plastic, aluminum, or a heavy metal.

In another aspect the present disclosure relates to said material roll support system wherein the holder end incorporates an extension portion that is at least partially rounded, whereby the roll of material rotates around the extension portion positioned within the roll of the roll of material.

In another aspect the present disclosure relates to said material roll support system wherein the connector is positioned through holes within the holder base unit and a hole within the holder end, said holes being virtually aligned when the connector is positioned within all of said holes simultaneously.

In another aspect the present disclosure relates to a method of assembling and using a material roll support system to hold a roll of material, comprising the steps of: positioning two independent holder units upon separate supports, said supports being a distance from each other that is greater than and near to the width of the roll of material, and said independent holder units each comprising: a holder base unit; a holder end that is attached to the holder base unit; and a connector that connects the holder end to the holder base unit; rotating at least one of the holder ends around the axis defined by the connector to raise the at least one of the holder ends in relation to the holder base unit attached to said holder end; positioning at least a portion of the holder ends within a roll section of the roll of material; lowering the at least one of the holder ends that is raised, such that a greater portion of the holder end that is lowering is positioned within the roll section as a result of said lowering; and supporting the roll of material upon the holder ends, such that the roll of material rotates around the holder ends.

In another aspect the present disclosure relates to said method further comprising the step of moving the material roll support system to be positioned upon different supports.

In another aspect the present disclosure relates to said method further comprising the step of positioning the material roll support system upon supports that are varying widths apart, whereby the material roll support system is operable to support rolls of material of varying widths.

In another aspect the present disclosure relates to said method further comprising the step of dispensing material wound upon the roll of material as the roll of material rotates around the holder ends.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood and objects of the invention will become apparent when consideration is given to the following detailed description thereof. Such description makes reference to the annexed drawings wherein.

Figure 1:
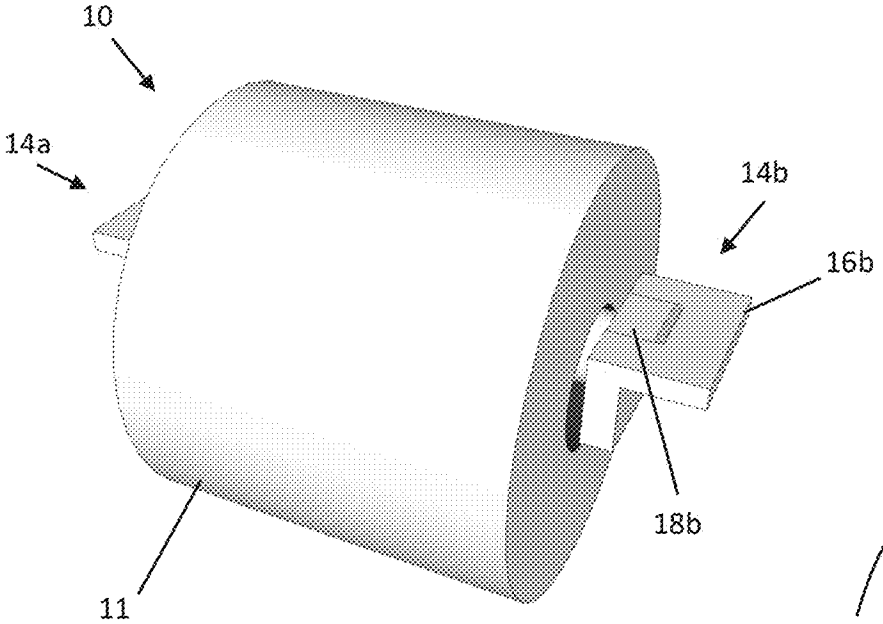
FIG. 1 is a front perspective view of a roll of paper positioned upon two independent holder units, in accordance with an embodiment of the present invention.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

The present invention is a material roll support system that is operable to hold of a roll of material. The material roll support system comprises two independent holder units, each of which can support one side of a roll of material. The independent holder units are not fixedly attached to any surface, and can be moved. The independent holder units can further be positioned upon one or more support, such as posts, pre-installed surfaces, or other surfaces, such that a roll of material can be held by the independent holder units in an area or environment that contains such supports. The supports are not required to be configured in any manner to have any shape or other characteristic that relates specifically to the independent holder units. The supports should be positioned along a horizontal or near-horizontal plane, or any other plane whereby the independent holder units can be positioned thereon and can hold a roll of material between said independent holder units, whereby the roll of material can dispense material. The independent holder units can further be positioned at varying distances from each other and thereby can be used to support rolls of materials of various widths.

The independent holder units can be utilized to support a roll of material permanently or for a short period of time. As an example, the independent holder units can be used to position a roll of material that is a roll of plastic wrap upon permanent supports in a kitchen area for a long period of time. As another example, the independent holder units can be positioned upon either permanent supports (e.g., bars or posts fixed to a wall or another surface, or permanent surfaces, such as counter top sections, within a building that remain a particular distance apart), or temporary supports (e.g., bars, posts, ledges, or other surfaces that are moved into a particular location and positioned a certain distance from each other in a non-fixed manner), and possible makeshift supports (e.g., tree branches, sticks, the arms of folding chairs, or any other surfaces that are temporarily positioned and utilized as supports in a non-fixed manner), such as may be used at a camping ground to support a roll of material such as a roll of paper towel, or at any other non-permanent location whereby a roll of material can be dispensed for a short period of time.

Once an independent holder unit is positioned upon a support, the independent holder unit can remain in that position due to gravity, or it can be attached to a support in fixed or non-fixed manner. For example, tape, nails, screws, or some other attachment material or item can be utilized to hold the independent holder unit in a particular position in a fixed or non-fixed manner. If an independent holder unit is fixedly attached to a support then the support may not be required to be positioned along a horizontal plane, as the independent holder unit will not slide when the plane of the support is altered to be a vertical or near-vertical plane.

A roll of material may still rotate around the holder end, or a portion thereof, of the independent holder unit if the independent holder unit is attached to a support that is not along a horizontal plane. Therefore, the independent holder units may be positioned at varying angles and still function as described herein. Also, the two independent holder units may be positioned at different angles. Therefore, the supports are not required to be positioned along identical planes in order for the material roll support system to be operable to dispense material from a roll of material positioned between and supported on opposite ends by at least a portion of the holder ends of the independent holder units.

Each independent holder unit comprises a holder base unit to which a holder end is connected. The holder end is rotatable around an axis in relation to the holder base unit. The axis may be defined by a connector that connects the holder end to the holder base unit. Generally a connector is inserted into holes in each of the holder end and the holder base unit, as described herein. The holder end may thereby be lifted and lowered in relation to the holder base unit as it rotates around the axis.

The holder base unit and holder end may be formed of a variety of materials, including any type of plastic, including a polyvinyl chloride (PVC) plastic, or aluminum, or virtually any other material. The holder base unit and holder end may further be formed of different materials, or a mixture of materials. It is preferable that the holder base unit and holder end not be formed of a heavy metal, but the invention will function as described herein even if a heavy metal is utilized to form the holder base unit and holder end unit.

When each of the independent holder units are positioned upon supports such that the holder end of each unit faces the holder end of the other unit, a roll of material may be positioned upon the holder ends, or at least a portion thereof. When a roll of material is positioned upon the holder ends, at least a portion of each of the holder ends may be positioned within the roll of material on opposite sides of said roll of material.

To cause the holder ends to be positioned within the roll of material, or at least a portion thereof to be positioned within the roll of material, one or more of the holder ends may be raised in relation to the holder base unit. Raising of one or more of the holder ends increases the distance between the independent holder units as measured as the distance between the ends of the holder ends closest to each other. Thus, raising one or more of the holder ends creates space wherein the roll of material may be positioned between, or removed from between, the independent holder units.

In embodiments of the present invention, a component may be positioned between the holder base unit and the holder end. Such component may act to cause a holder end that is raised to return to the lowered position in relation to the holder base unit. In this manner, such a component induces the raised holder end to move in a lowering direction in relation to the holder base unit. This component maybe formed of rubber or any other material that will induce a holder end that is raised to return to the lowered position in relation to the holder base unit. In some embodiments of the present invention, this component may be a spring or a magnet that would function to induce a holder end that is raised to return to the lowered position in relation to the holder base unit.

Some possible embodiments of the present invention are shown in the drawings. A skilled reader will recognize that other embodiments are also possible and that the drawings merely provide examples of some embodiments of the present invention.

As shown in FIG. 1, the material roll support system 10 of the present invention comprises two independent holder units 14*a*, 14*b*. The independent holder units are positioned at a distance from each other that is slightly greater than the width of a roll of paper 11. The roll of paper is thereby able to fit between the independent holder units.

Figure 2:
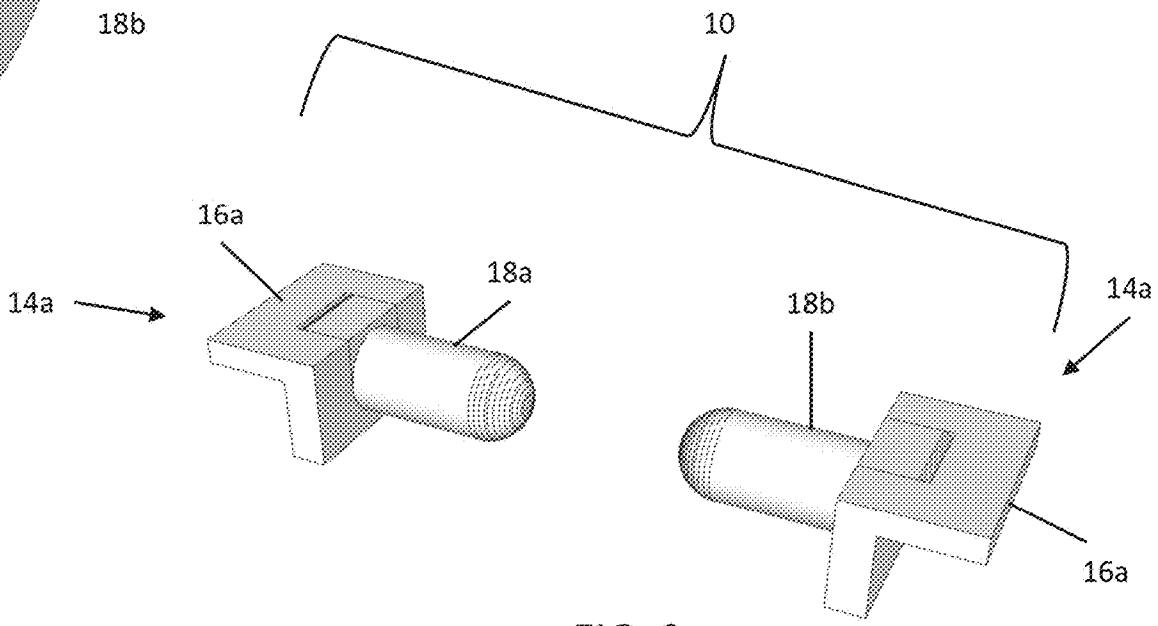
FIG. 2 is a front perspective view of two independent holder units positioned to be ready to support a roll of paper, in accordance with an embodiment of the present invention.

As shown in FIG. 2, the material roll support system 10 of the present invention is configured such that the independent holder units 14*a*, 14*b* are positioned in relation to each other so that the ends of the holder ends 18*a*, 18*b* of each independent holder unit, being the ends that are not attached to the holder base units, are facing each other. In such a position, the holder base units 16*a*, 16*b* of each independent holder unit, to which the holder ends are attached, are positioned more distantly from each other than the holder ends. The distance between the holder base units is slightly wider than the width of the roll of material that will be supported by the material roll support system.

Figure 4:
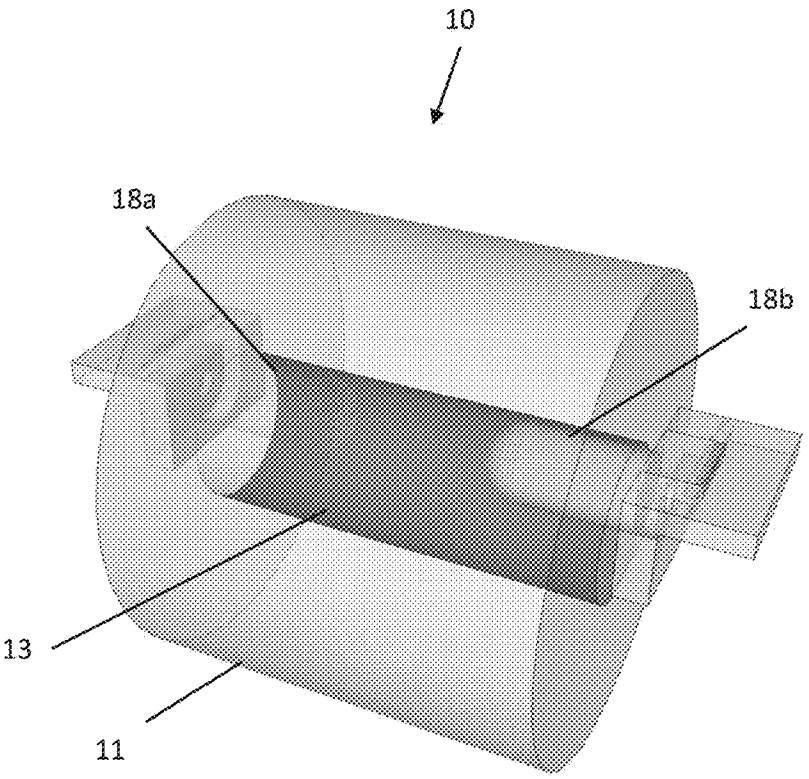
FIG. 4 is a schematic representation of a roll of paper positioned upon two independent holder units, wherein the holder ends are lowered, in accordance with an embodiment of the present invention.
Figure 3:
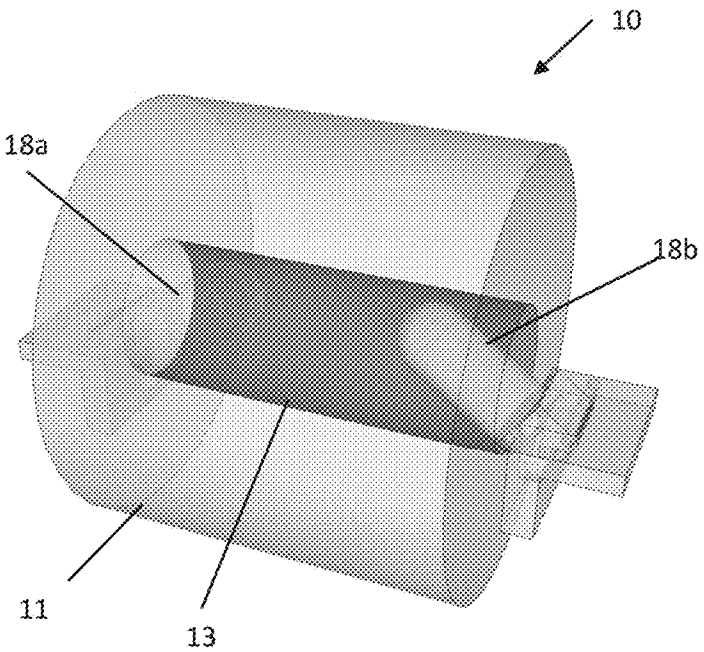
FIG. 3 is a schematic representation of a roll of paper positioned upon two independent holder units, wherein the holder ends are raised, in accordance with an embodiment of the present invention.

As shown in FIG. 4, when a roll of material 11 is positioned so as to be supported by the material roll support system 10, the holder ends 18*a*, 18*b* may be in a lowered position in relation to the holder base units to which each holder end is attached. To position the roll of material 11 upon the holder ends, or remove the roll of material from the holder ends, one or more of the holder ends 18*a*, 18*b* can be raised, as shown in FIG. 3. The raising of each holder end, in relation to the holder base unit to which it is attached, increases the distance between the independent holder units. When the holder end is raised sufficiently the roll of material may be positioned between the independent holder units, or it may be removed from being positioned between the independent holder units.

In order for a roll of material to be supported between the independent holder units, at least a portion of the holder ends of each independent holder unit must be positioned inside of the roll section 13 of the roll of material 11. The exertion of force upon the material that is wound around the roll section of the roll of material will cause the roll to rotate around the holder ends. The material wound upon the roll of material may be dispensed as the roll of material rotates around the holder ends in one direction. The material wound upon the roll of the material may not be dispensed if the roll of material rotates around the holder ends in the opposite direction, and in such a direction any dispensed material may be retracted and rewound upon the roll.

Figure 6:
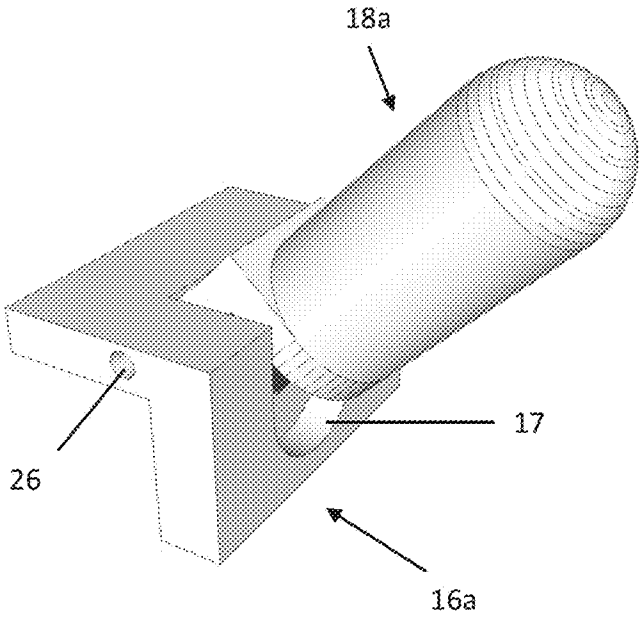
FIG. 6 is a side perspective view of one independent holder unit with the holder end in a raised position, in accordance with an embodiment of the present invention.

To position the roll of material upon the holder ends, at least a portion of the holder ends must be positioned inside the roll section of the roll of material. At least one of the holder ends is raised before the roll of material is positioned between the independent holder units. The raised holder end will only have a small portion of thereof positioned within the roll section when it is raised, but as the holder end is lowered in relation to the holder base unit to which it is attached, a greater portion of the holder end will be positioned within the roll section. As shown in FIG. 6, the holder end rotates around an axis defined by a post inserted into a hollow section 26 of the holder base unit and through the holder end to move between the raised and lowered positions.

Figure 8:
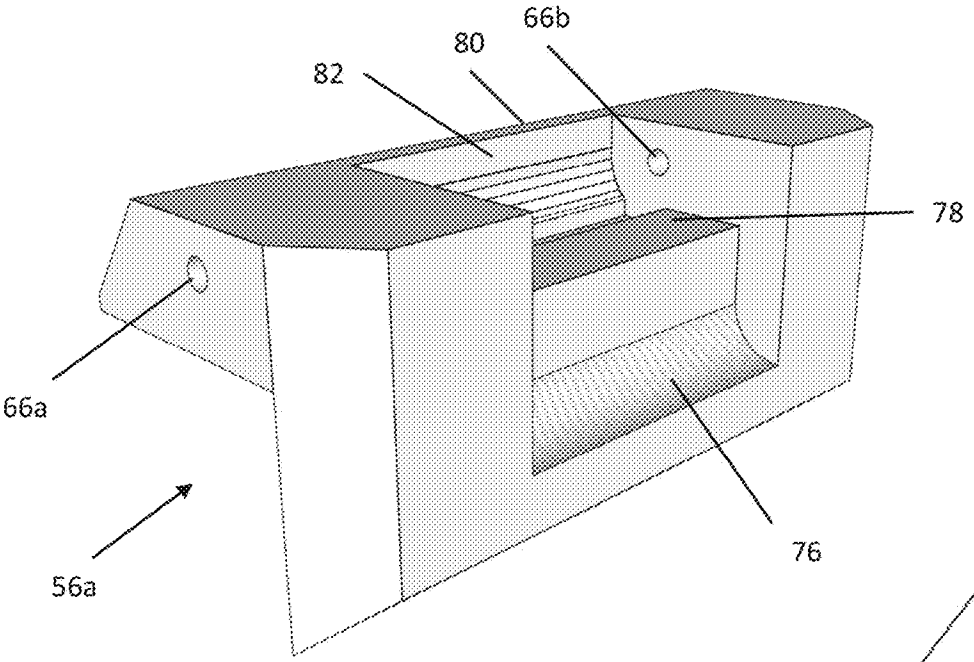
FIG. 8 is a side perspective view of a holder base unit, in accordance with an embodiment of the present invention.

A holder base unit may be configured to incorporate an indentation section 17. The indentation section may be shaped in a variety of manners. For example, as shown in FIG. 8, the indentation section may incorporate an indentation lower section 76 and an indentation upper section 82. There may further be a termination surface 78 formed within the indentation section. Generally, the indentation section is configured in relation to the shape of the holder end.

As shown in FIG. 6, when the holder end is raised the holder end is distant from the indentation section, and is not in contact with the indentation section. However, when the holder end is lowered it will move closer to the indentation section and a portion of the holder end will eventually contact the indentation section. For this reason the configuration of the indentation section may be created in accordance with the holder end portion that will be positioned within the indentation section when the holder end is in a lowered position.

When the holder end is in full contact with the indentation section the holder end will not be able to be lowered any further in relation to the holder base unit. For example, when a portion of the holder end is in contact with the indentation lower section 76 as shown in FIG. 8, such contact may restrict or otherwise limit any further rotation in a lowering direction of the holder end around the axis of its connection with the holder base unit, as described herein. The termination surface 78 may further be formed such that when the holder end is in contact with the termination section the holder end is prevented and otherwise restricted from any further rotation in a lowering direction of the holder end around the axis of its connection with the holder base unit. The restriction, prevention or any other limit on the rotation of the holder end, such that affects either the raising or lowering of the holder end in relation to the holder base unit will cause the holder end to be unable to be raised or lowered any further beyond the point when such restricting contact between the holder end and one or more portions of the indentation section occurs.

A skilled reader will recognize that various elements to restrict the lowering or raising of the holder end in relation the holder base unit may be incorporated in embodiments of the present invention. The termination section is but one example of an element to restrict the lowering of the holder end in relation to the holder base unit. Such restricting elements can be operable to support the holder end in the raised or lowered position at the restricting position. For example, the termination section restricts the lowering of the holder end, and when the holder end is so restricted by the termination section, the termination section may support some of the weight of the roll of material positioned upon the holder end or a portion thereof.

Figure 5:
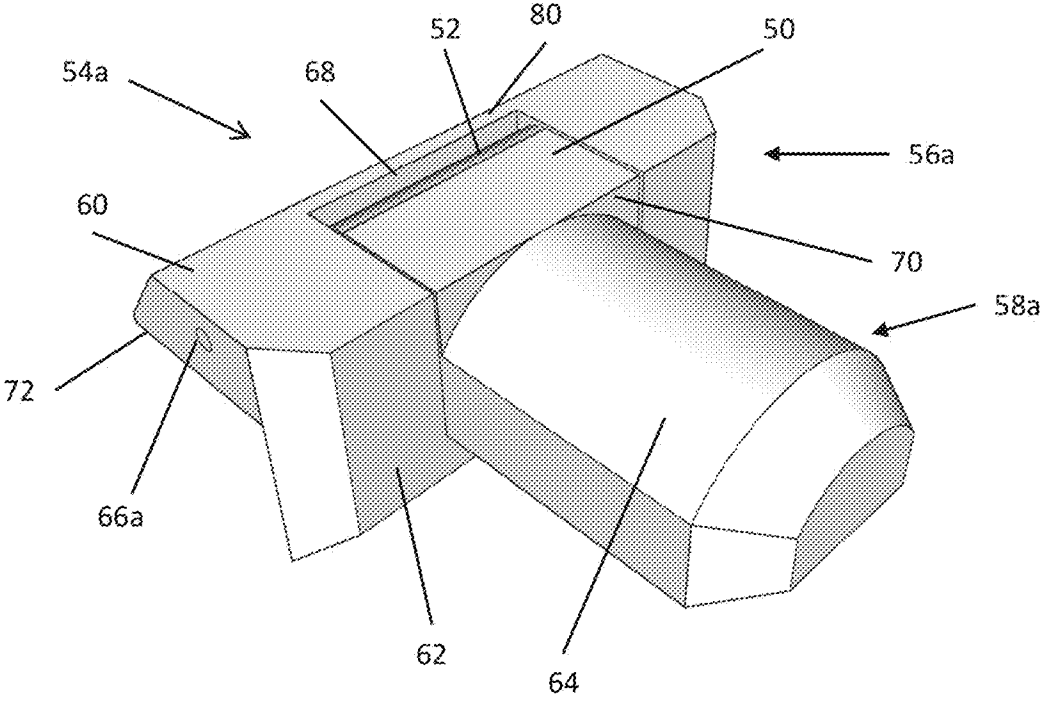
FIG. 5 is a side perspective view of one independent holder unit, in accordance with an embodiment of the present invention.

The independent holder units may have variant configurations in embodiments of the present invention. In one embodiment of the present invention, as shown in FIG. 5, an independent holder unit 54*a*, may comprise a holder end 58*a* that may have an extension portion 64 that is at least partially rounded. The extension portion may extend outside of the section of the holder end that fits within any indentation section of the holder base unit. The rounded shape of the extension portion aids the roll section of the roll of material to rotate around such extension portion when at least a portion of the extension section is positioned within the roll section with reduced friction in relation to an extension portion that is not so rounded.

The extension portion 64 of the holder end may be attached to a rotation section of the holder end. The rotation section may be configured to include a front wall 70 that connects with the extension portion, and a top wall 50 that may be aligned with the top section 60 of the holder base unit. The rotation section, or at least a portion thereof, may be positioned within the indentation section formed in the holder base unit when the holder end is in a lowered position in relation to the holder base unit.

A lowering component 52, formed of a material such as rubber or some other material may be positioned between the rotation section and the upper wall 68 of the indentation section. The lowering component may be operable to prompt a raised holder end to move to a lowered position in relation to the holder base unit. Therefore, once a roll of material is started to be positioned upon a raised holder end the holder end will be induced by the lowering component to move in the direction of lowering in relation to the holder base unit, and thereby the holder end will move so as to be increasingly positioned within the roll section of the roll of material as the holder end lowers. The roll of material can be supported on one side upon the holder end, or at least a portion thereof, when the holder end is lowered. When both holder ends of the material roll support system are positioned within, or at least partially within, the roll of the roll of the material, the roll may be supported between the independent holder units of the material roll support system.

A back section 80 of the holder base unit may extend behind the indentation section. The holder base unit may further have a front facing wall 62 that extends on either side of the indentation section. In a side wall 72, a hole 66*a* or other hollow section may be configured to receive a post that may be extended through the hole, through a hollow section in the holder end and into a second hole in the opposite side wall of the holder base unit, said second hole being positioned on the opposite side of the indentation section.

As shown in FIG. 6, the holder base unit 16*a* and the holder end 18*a* may have different configurations in other embodiments of the present invention.

Figure 7:
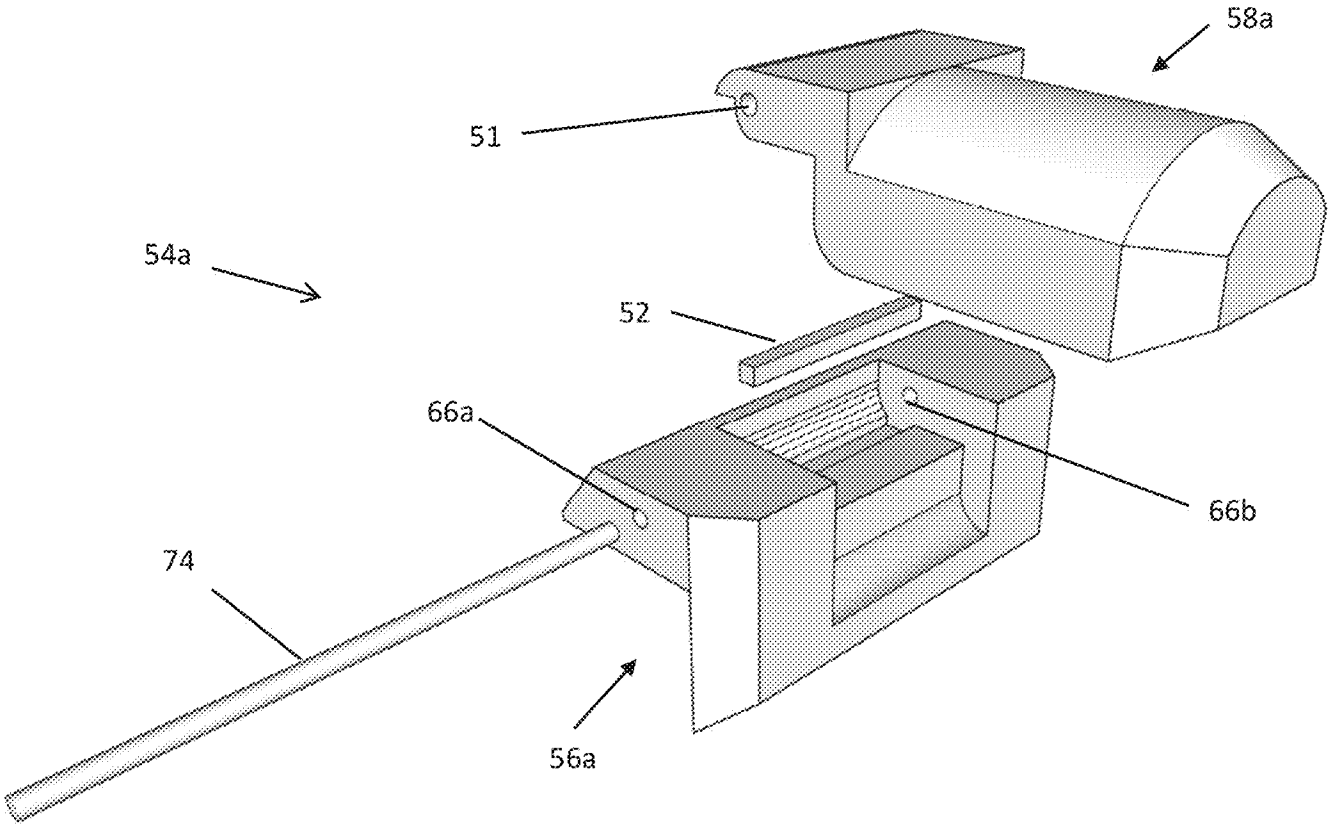
FIG. 7 is an exploded view of one independent holder unit, in accordance with an embodiment of the present invention.
Figure 9:
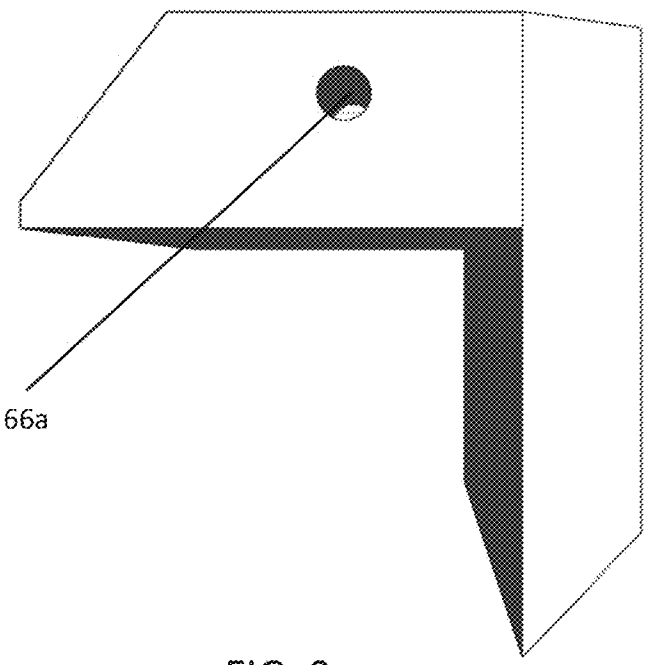
FIG. 9 is a side view of a holder base unit, in accordance with an embodiment of the present invention.

An independent holder unit 54*a*, may be assembled when the holder end 58*a* is positioned within the indentation section of the holder base unit and a connector, such as a post, connects the holder end to the holder base unit. For example, a post 74, as shown in FIG. 7, may fit within hole 66*a*, through the holder end hole 51, and through opposite hole 66*b* of the holder base unit. As shown in FIG. 9, the hole 66*a* may be aligned with the opposite second hole 66*b*. When the post connects the holder end to the holder base unit, the holder end can rotate around the axis of the post in relation to the holder base unit. A skilled reader will recognize that the post or other connector can be formed of a variety of materials, and may be a pin or other alternative element.

Figure 10:
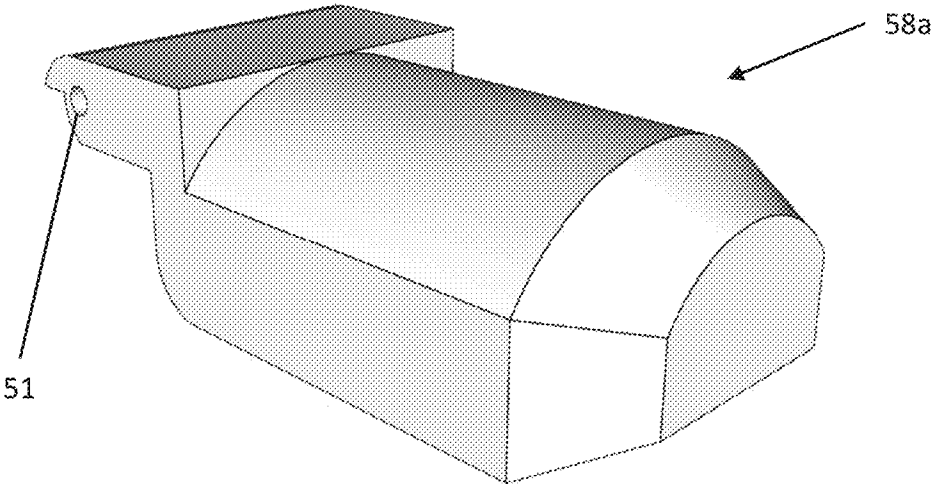
FIG. 10 is a side perspective view of a holder end, in accordance with an embodiment of the present invention.
Figure 11:
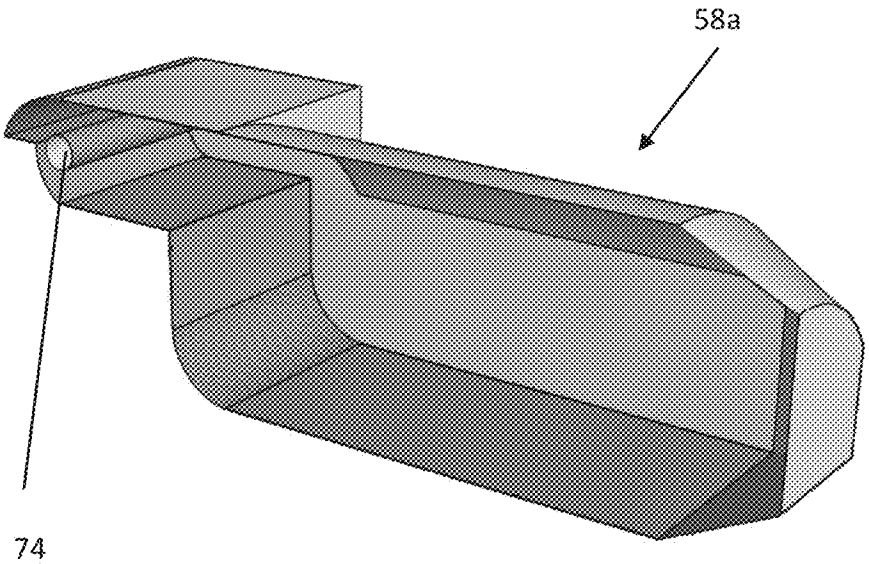
FIG. 11 is a horizontal cross-section view of a holder end, in accordance with an embodiment of the present invention.

The holder end hole 51 extends through the holder end 58*a* in a direction and a position such that said hole that is parallel or virtually parallel to the top surface of the holder end where the hole is positioned, as shown in FIG. 10. Alternatively, the interior of the holder end may be hollow, as shown in FIG. 11. In such an embodiment of the present invention the post 74 may extend through the holder end hole 51, into and through the hollow interior of the holder end, and out through a hole on the opposite side of the holder end that is aligned or virtually or nearly aligned with holder end hole 51. Such a hole on the opposite side of the holder end may further be virtually or nearly aligned with the opposite hole 66*b* of the holder base unit when the holder end is positioned within the indentation section in a lowered position.

Each of the independent holder units can be placed upon supports that are each positioned such that the independent holder unit thereon does not slide when so placed, either due to gravity or due to some fixed or non-fixed attachment of the independent holder unit to said support. For example, the supports may be positioned so as to each provide a section that is along a horizontal or near horizontal plane, or some other plane, whereupon the independent holder units may be positioned opposite each other. Otherwise, a support does not need to be configured in any particular manner for an independent holder unit to be positioned thereupon. The only condition that supports must meet to be used in the material roll support system is that one or more supports must be positioned such that the independent holder units can be positioned at a distance from each other and in relation to each other such that the independent holder units are positioned so as to be used in combination to hold a roll of material in accordance with the description of the material roll support system herein.

Figure 12:
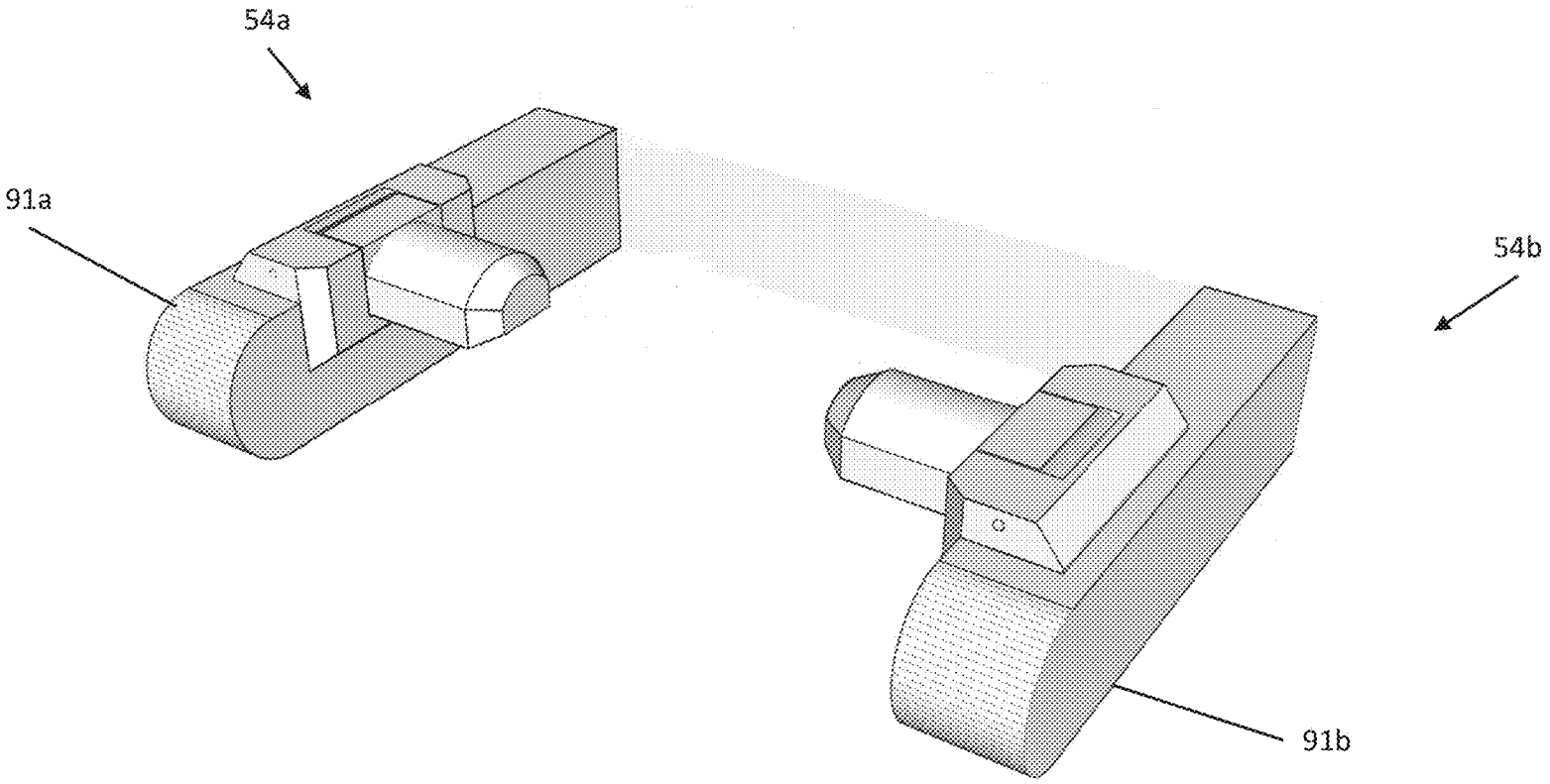
FIG. 12 is a side perspective view of two independent holder units positioned upon supports, in accordance with an embodiment of the present invention.

For example, as shown in FIG. 12, the independent holder 54*a*, 54*b* units may be positioned upon non-fixed supports 91*a*, 91*b*. In this manner the material roll support system may be a temporary system for supporting a roll of material. As an example, a material roll support system may be used at a trade show, at a camp ground or cottage, at a picnic site, in a building, or anywhere else, to support a roll of material whereby material can be dispensed therefrom, for a limited period of time.

Figure 13:
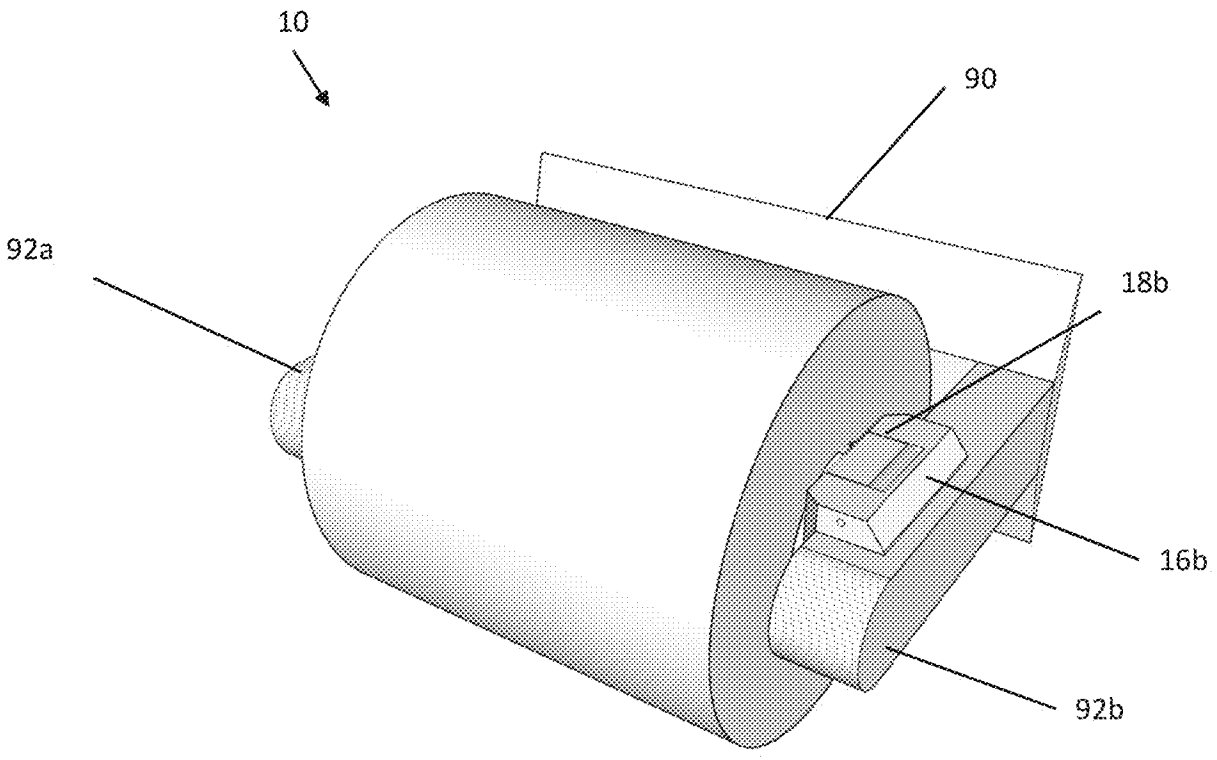
FIG. 13 is a side perspective view of two independent holder units each positioned upon supports that are connected to a backing portion that is connected to a wall, in accordance with an embodiment of the present invention.

An another example, as shown in FIG. 13, fixed supports 92*a*, 92*b* may be attached to a wall or to another backing section 90 that may be attached to a wall or another surface. This configuration of fixed supports may incorporate a permanent support. For example, the fixed supports may be portions incorporated in an existing toilet roll holder apparatus. For various reasons, such as ease of replacing the toilet roll, a user may not wish to use the fixed toilet roll holder other than to provide supports upon which the independent holder units may be positioned thereupon, in a fixed or an unfixed manner. A skilled reader will recognize there are many other types of fixed supports upon which the independent holder units of the present invention may be positioned in an embodiment of the material roll support system disclosed herein. Thus, the material roll support system and the method of using said system may incorporate two independent holder units, each incorporating a holder base unit 16*b* and a holder end 18*b*, and each being positioned in relation to one of two support, each positioned in relation to a different support, that already exist in a building. The material roll support system 10 may be so used in a permanent manner, or for an extended period of time in relation to such supports to support a roll of material whereby material therefrom can be dispensed (or rolls of material as the roll of material may be replaced once the material thereupon is all dispensed). Or the material roll support system may only be used in a temporary manner for a limited period of time in relation to such supports to support a roll or rolls of material consecutively, as described herein.

It will be appreciated by those skilled in the art that other variations of the embodiments described herein may also be practiced without departing from the scope of the invention. Other modifications are therefore possible.

We claim:

1. A material roll support system comprising:

(a) two independent holder units, each independent holder unit incorporating:
  (i) a holder base unit;
  (ii) a holder end that is attached to the holder base unit; and
  (iii) a connector that connects the holder end to the holder base unit such that the holder end is rotatable around an axis defined by the connector and can be raised and lowered in relation to the holder base unit;

whereby a roll of material is supportable between the two independent holder units when the holder ends are positioned within a roll section of the roll of material, and the holder units are each in contact with and supported on an upper flat surface of one or more supports.

2. The material roll support system of claim 1, further comprising two supports that the independent holder units are positioned upon when the material roll support system is assembled and operable.

3. The material roll support system of claim 1, further comprising an indentation section in the holder base unit configured to receive a portion of the holder end.

4. The material roll support system of claim 3, wherein the indentation section is formed to restrain lowering of the holder end beyond a particular lowered position.

5. The material roll support system of claim 1, further comprising a lowering inducing component positioned between the holder end and the holder base unit near to the connector, said lowering inducing component being operable to cause a raised holder end to start to move in a lowering direction.

6. The material roll support system of claim 5, wherein the lowering inducing component is formed of rubber, or the lowering inducing component is a magnet or a spring.

7. The material roll support system of claim 1, wherein the holder end and holder base unit are formed of plastic, polyvinyl chloride (PVC) plastic, aluminum, or a heavy metal.

8. The material roll support system of claim 1, wherein the holder end incorporates an extension portion that is at least partially rounded, whereby the roll of material rotates around the extension portion positioned within the roll of the roll of material.

9. The material roll support system of claim 1, wherein the connector is positioned through holes within the holder base unit and a hole within the holder end, said holes being virtually aligned when the connector is positioned within all of said holes simultaneously.

10. A method of assembling and using a material roll support system to hold a roll of material, comprising the steps of:

a. positioning two independent holder units above, in contact with and on top of an upper surface of separate supports, whereby the portion of each holder unit in contact with each support is a flat or virtually flat surface, said supports being a distance from each other that is greater than and near to the width of the roll of material, and said independent holder units each comprising:
  i. a holder base unit;
  ii. a holder end that is attached to the holder base unit; and
  iii. a connector that connects the holder end to the holder base unit;
b. rotating at least one of the holder ends around the axis defined by the connector to raise the at least one of the holder ends in relation to the holder base unit attached to said holder end;
c. positioning at least a portion of the holder ends within a roll section of the roll of material;
d. lowering the at least one of the holder ends that is raised, such that a greater portion of the holder end that is lowering is positioned within the roll section as a result of said lowering; and
e. supporting the roll of material upon the holder ends, such that the roll of material rotates around the holder ends.

11. The method of claim 10, further comprising the step of moving the material roll support system to be positioned upon other separate supports that are distinct from the separate supports that the material roll holder is initially supported upon, whereby the material roll holder can be successively moved to different locations where it will be supported upon supports located in such different locations, and thereby is non-permanent.

12. The method of claim 10, further comprising the step of positioning the material roll support system upon supports that are varying widths apart, whereby the material roll support system is operable to support rolls of material of varying widths.

13. The method of claim 10, further comprising the step of dispensing material wound upon the roll of material as the roll of material rotates around the holder ends.

* * * * *